US012048329B2

(12) United States Patent
Lomas et al.

(10) Patent No.: US 12,048,329 B2
(45) Date of Patent: Jul. 30, 2024

(54) CONSUMABLE FOR A SMOKING SUBSTITUTE DEVICE

(71) Applicant: Imperial Tobacco Limited

(72) Inventors: Pete Lomas, Liverpool (GB); Chris Lord, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 712 days.

(21) Appl. No.: 17/201,444

(22) Filed: Mar. 15, 2021

(65) Prior Publication Data

US 2021/0259308 A1 Aug. 26, 2021

Related U.S. Application Data

(63) Continuation of application No. PCT/EP2019/074489, filed on Sep. 13, 2019, and a (Continued)

(30) Foreign Application Priority Data

Sep. 14, 2018 (GB) ..... 1814980
Sep. 14, 2018 (GB) ..... 1814985
(Continued)

(51) Int. Cl.
*A24F 40/42* (2020.01)
*A24F 7/00* (2006.01)
(Continued)

(52) U.S. Cl.
CPC ..... *A24F 40/42* (2020.01); *A24F 7/00* (2013.01); *A24F 40/10* (2020.01); *A24F 40/485* (2020.01); *A24F 40/70* (2020.01)

(58) Field of Classification Search
CPC ..... A24F 40/42; A24F 40/70; A24F 40/485; A24F 40/10; A24F 7/00
See application file for complete search history.

(56) References Cited

U.S. PATENT DOCUMENTS 9,980,522 B1 5/2018 Heidl et al.
10,603,459 B2 * 3/2020 Kotch ..... A24F 40/42
(Continued)

FOREIGN PATENT DOCUMENTS

CN 104 366 698 A 2/2015
CN 104 544 566 A 4/2015
(Continued)

OTHER PUBLICATIONS

UK Intellectual Property Office; Combined Search and Examination Report in GB1814980.7, filed Sep. 14, 2018, dated Feb. 11, 2019.
(Continued)

*Primary Examiner* — Thanh Tam T Le
(74) *Attorney, Agent, or Firm* — DUNLAP CODDING, P.C.

(57) ABSTRACT

A consumable for a smoking substitute device, the consumable comprising: a tank for storing an e-liquid; an outlet, wherein the outlet is configured to provide fluid communication between the tank and a mouthpiece aperture, so that the mouthpiece aperture receives an aerosol vapour formed from the e-liquid in use, wherein the outlet is integrally formed with the tank; and a support for maintaining a position of the outlet relative to the tank.

14 Claims, 5 Drawing Sheets

Related U.S. Application Data continuation of application No. PCT/EP2019/074492, filed on Sep. 13, 2019, and a continuation of application No. PCT/EP2019/074483, filed on Sep. 13, 2019, and a continuation of application No. PCT/EP2019/074495, filed on Sep. 13, 2019, and a continuation of application No. PCT/EP2019/074498, filed on Sep. 13, 2019.

(30) Foreign Application Priority Data

| | | |
|---|---|---|
| Sep. 14, 2018 | (GB) | 1814986 |
| Sep. 14, 2018 | (GB) | 1814987 |
| Sep. 14, 2018 | (GB) | 1814989 |
| Sep. 14, 2018 | (GB) | 1814995 |

(51) Int. Cl.

| | |
|---|---|
| ***A24F 40/10*** | (2020.01) |
| ***A24F 40/485*** | (2020.01) |
| ***A24F 40/70*** | (2020.01) |

(56) References Cited

U.S. PATENT DOCUMENTS

| | | | | |
|---|---|---|---|---|
| 10,621,911 | B2 * | 4/2020 | Onoyama | G09G 3/3233 |
| 10,791,763 | B2 * | 10/2020 | Chen | H05B 1/0227 |
| 10,834,965 | B2 * | 11/2020 | Zhu | H05B 3/48 |
| 10,834,966 | B2 * | 11/2020 | Zhu | A24B 15/167 |
| 11,006,670 | B2 * | 5/2021 | Chen | A24F 40/50 |
| 11,019,846 | B2 * | 6/2021 | Ding | A24F 40/42 |
| 11,213,635 | B2 * | 1/2022 | Hepworth | A61M 11/042 |
| 11,297,881 | B2 * | 4/2022 | Qiu | A24F 40/485 |
| 11,324,253 | B2 * | 5/2022 | Liu | A24F 40/05 |
| 11,357,262 | B2 * | 6/2022 | Rogan | A24F 40/42 |
| 11,433,191 | B2 * | 9/2022 | Fallon | A24F 40/42 |
| 11,632,978 | B2 * | 4/2023 | Rojo-Calderon | A24F 40/465 131/111 |
| 2018/0084830 | A1 | 3/2018 | Xu | |
| 2018/0249761 | A1 | 9/2018 | Servutas | |

FOREIGN PATENT DOCUMENTS

| | | | |
|---|---|---|---|
| CN | 204 306 042 | U | 5/2015 |
| CN | 104 770 900 | A | 7/2015 |
| CN | 206 062 138 | U | 4/2017 |
| CN | 206 453 255 | U | 9/2017 |
| CN | 206 744 571 | U | 12/2017 |
| CN | 206 821 984 | U | 1/2018 |
| CN | 207 040 881 | U | 2/2018 |
| CN | 207 613 208 | U | 7/2018 |
| DE | 20 2016 101676 | U1 | 5/2016 |
| EP | 2 835 061 | A1 | 2/2015 |
| EP | 2 885 986 | A1 | 6/2015 |
| EP | 3 103 356 | B1 | 12/2016 |
| EP | 3 135 140 | A1 | 3/2017 |
| EP | 3 138 427 | A1 | 3/2017 |
| EP | 3 158 883 | A2 | 4/2017 |
| EP | 3 257 387 | A1 | 12/2017 |
| EP | 3 298 911 | A1 | 3/2018 |
| EP | 3 305 111 | A2 | 4/2018 |
| GB | 385 726 | A | 1/1933 |
| WO | WO 2014 130 772 | A1 | 8/2014 |
| WO | WO 2015 117 700 | A1 | 8/2015 |
| WO | WO 2015 117 704 | A1 | 8/2015 |
| WO | WO 2015/117704 | A1 | 8/2015 |
| WO | WO 2016/126544 | A1 | 8/2016 |
| WO | WO 2017 186 023 | A1 | 11/2017 |
| WO | WO 2018/037245 | A1 | 3/2018 |
| WO | WO 2018/083037 | A1 | 5/2018 |

OTHER PUBLICATIONS

UK Intellectual Property Office; Combined Search and Examination Report in GB1814985.6, filed Sep. 14, 2018, dated Feb. 25, 2019.

UK Intellectual Property Office; Combined Search and Examination Report in GB1814986.4, filed Sep. 14, 2018, dated Feb. 27, 2019.

UK Intellectual Property Office; Combined Search and Examination Report in GB1814987.2, filed Sep. 14, 2018, dated Feb. 21, 2019.

UK Intellectual Property Office; Combined Search and Examination Report in GB1814989.8, filed Sep. 14, 2018, dated Feb. 21, 2019.

UK Intellectual Property Office; Combined Search and Examination Report in GB1814995.5, filed Sep. 14, 2018, dated Jan. 31, 2019.

RevPart, Mar. 30, 2016, Injection Molding Best Practices: Draft Angles For Every Part, revpart.com, [Online], Available from: https://revpart.com/draft-angles-for-injection-molding/ [Accessed Feb. 20, 2019].

Jaycon Systems, Jul. 13, 2017, Injection Molding 101: Draft Angles, YouTube, [Online], Available from: https://www.youtube.com/watch?v=RMO2u9Gylz4 [Accessed Feb. 20, 2019].

International Search Report and Written Opinion (PCT/EP2019/074483); Dec. 19, 2019; 10 pgs.

International Search Report and Written Opinion (PCT/EP2019/074489); Dec. 13, 2019; 11 pgs.

International Search Report and Written Opinion (PCT/EP2019/074492); Feb. 13, 2020; 16 pgs.

International Search Report and Written Opinion (PCT/EP2019/074495); Dec. 19, 2019; 11 pgs.

International Search Report and Written Opinion (PCT/EP2019/074498); Dec. 18, 2019; 13 pgs.

* cited by examiner

CONSUMABLE FOR A SMOKING SUBSTITUTE DEVICE

CROSS REFERENCE TO RELATED APPLICATIONS/INCORPORATION BY REFERENCE STATEMENT

This application is a continuation of International Application No. PCT/EP2019/074498, filed Oct. 23, 2019; which claims benefit of GB Application No. 1814995.5, filed Sep. 14, 2018. This application is also a continuation of International Application No. PCT/EP2019/074495, filed Oct. 23, 2019; which claims benefit of GB Application No. 1814989.8, filed Sep. 14, 2018. This application is also a continuation of International Application No. PCT/EP2019/074492, filed Oct. 23, 2019; which claims benefit of GB Application No. 1814987.2, filed Sep. 14, 2018. This application is also a continuation of International Application No. PCT/EP2019/074489, filed Oct. 23, 2019; which claims benefit of GB Application No. 1814986.4, filed Sep. 14, 2018. This application is also a continuation of International Application No. PCT/EP2019/074483, filed Oct. 23, 2019; which claims benefit of GB Application No. 1814985.6, filed Sep. 14, 2018. The entire contents of each of the above-referenced patents and patent applications are hereby expressly incorporated herein by reference.

TECHNICAL FIELD

The present disclosure relates to a consumable for a smoking substitute device, a smoking substitute device, a method of manufacturing a consumable for a smoking substitute device and a manufacturing assembly and particularly, although not exclusively, to consumable in which a tank and a mouthpiece which are integrally formed.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices, which may also be known as electronic nicotine delivery systems, may comprise electronic systems that permit a user to simulate the act of smoking by producing an aerosol, also referred to as a "vapour", which is drawn into the lungs through the mouth (inhaled) and then exhaled. The inhaled aerosol typically bears nicotine and/or flavourings without, or with fewer of, the odour and health risks associated with traditional smoking.

In general, smoking substitute devices are intended to provide a substitute for the rituals of smoking, whilst providing the user with a similar experience and satisfaction to those experienced with traditional smoking and tobacco products.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilising a different smoking substitute approach. A smoking substitute approach corresponds to the manner in which the substitute system operates for a user.

One approach for a smoking substitute device is the so-called "vaping" approach, in which a vaporisable liquid, typically referred to (and referred to herein) as "e-liquid", is heated by a heating device to produce an aerosol vapour which is inhaled by a user. An e-liquid typically includes a base liquid as well as nicotine and/or flavourings. The resulting vapour therefore typically contains nicotine and/or flavourings. The base liquid may include propylene glycol and/or vegetable glycerin.

A typical vaping smoking substitute device includes a mouthpiece, a power source (typically a battery), a tank or liquid reservoir for containing e-liquid, as well as a heating device. In use, electrical energy is supplied from the power source to the heating device, which heats the e-liquid to produce an aerosol (or "vapour") which is inhaled by a user through the mouthpiece.

Vaping smoking substitute devices can be configured in a variety of ways. For example, there are "closed system" vaping smoking substitute devices which typically have a sealed tank and heating element which is pre-filled with e liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapour which is inhaled by a user through the mouthpiece.

Another example vaping smoking substitute device is the blu PROT™ e-cigarette. The blu PROT™ e cigarette is an open system device which includes a main body, a (refillable) tank, and a mouthpiece. The main body and tank are physically and electrically coupled together by screwing one to the other. The mouthpiece and refillable tank are physically coupled together by screwing one into the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapour which is inhaled by a user through the mouthpiece.

Another approach for a smoking substitute device is the so-called "heat not burn" ("HNB") approach in which tobacco (rather than e-liquid) is heated or warmed to release vapour. The tobacco may be leaf tobacco or reconstituted tobacco. The vapour may contain nicotine and/or flavourings. In the HNB approach the intention is that the tobacco is heated but not burned, i.e. does not undergo combustion.

A typical HNB smoking substitute device may include a main body and a consumable. The consumable may include the tobacco material. The main body and consumable may be configured to be physically coupled together. In use, heat may be imparted to the tobacco material by a heating device that is typically located in the main body, wherein airflow through the tobacco material causes moisture in the tobacco material to be released as vapour. A vapour may be formed from a carrier in the tobacco material (this carrier may for example include propylene glycol and/or vegetable glycerin) and additionally volatile compounds released from the tobacco. The released vapour may be entrained in the airflow drawn through the tobacco.

As the vapour passes through the smoking substitute device (entrained in the airflow) from an inlet to a mouthpiece (outlet), the vapour cools and condenses to form an aerosol (also referred to as a vapour) for inhalation by the user. The aerosol will normally contain the volatile compounds.

In HNB smoking substitute devices, heating as opposed to burning the tobacco material is believed to cause fewer, or smaller quantities, of the more harmful compounds ordinarily produced during smoking. Consequently, the HNB approach may reduce the odour and/or health risks that can arise through the burning, combustion and pyrolytic degradation of tobacco.

An example of the HNB approach is the IQOS® smoking substitute device from Philip Morris Ltd. The IQOS® smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapour and flavourings which may be drawn through the mouthpiece by the user through inhalation.

A second example of the HNB approach is the device known as "Glo"® from British American Tobacco p.l.c. Glo® comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapour and flavourings which may be drawn through the consumable by the user through inhalation. The tobacco, when heated by the heating device, is configured to produce vapour when heated rather than when burned (as in a smoking apparatus, e.g. a cigarette). The tobacco may contain high levels of aerosol formers (carrier), such as vegetable glycerine ("VG") or propylene glycol ("PG").

In prior art smoking substitute devices, some of the unvaporised e-liquid passes through the wick and to the mouthpiece. This may result in unvapourised e-liquid passing into the user's mouth, which may be unpleasant for the user. Further leakage occurs due to leakage paths present between the components of the consumable. Additionally, it is desirable to provide consumables which are easier and cheaper to manufacture.

The present disclosure has been devised in light of the above considerations.

BRIEF DESCRIPTION OF THE DRAWINGS

So that the invention may be understood, and so that further aspects and features thereof may be appreciated, embodiments illustrating the principles of the invention will now be discussed in further detail with reference to the accompanying figures, in which:

FIG. 1(*b*) is a side view of main body of the smoking substitute device;

FIG. 1(*c*) is a side view of consumable of the smoking substitute device;

FIG. 2(*b*) is a schematic drawing of the consumable;

FIG. 5(*b*) is a bottom view of the portion of the second consumable.

SUMMARY OF CERTAIN NON-LIMITING EMBODIMENTS

Figure 1A:
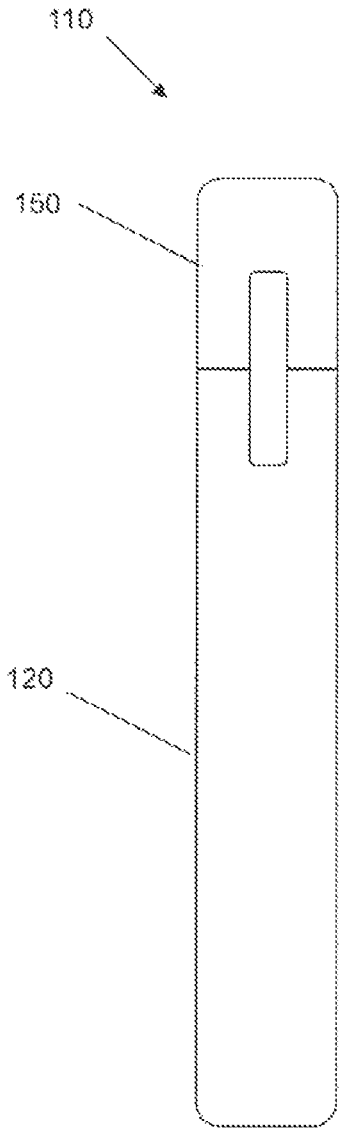
FIG. 1(*a*) is a side view of a smoking substitute device.

First Mode of Disclosure: Integral Forming of Outlet and Tank

At its most general, the present disclosure relates to a consumable for a smoking substitute device in which an outlet and tank are formed integrally, with a support maintaining a position of the outlet relative to the tank.

According to a first aspect of the first mode of the present disclosure, there is provided a consumable for a smoking substitute device, the consumable comprising: a tank for storing an e-liquid; an outlet, wherein the outlet is configured to provide fluid communication between the tank and a mouthpiece aperture, so that the mouthpiece aperture receives an aerosol vapour formed from the e-liquid in use, wherein the outlet is integrally formed with the tank; and a support for maintaining a position of the outlet relative to the tank.

The support is provided to maintain the spacing between the outlet and the tank and thus strengthen the consumable. Without the support, even though integrally formed, the outlet may flex relative to the tank, the resulting distortion having the potential to create weakness within the consumable.

Optionally, the support is integrally formed with the tank and outlet.

Advantageously, the support comprises a rib.

Conveniently, the rib extends from the outlet in a radially outward direction to an internal surface of a wall of the tank. By spanning the spacing between the wall of the tank and the outlet, the position of the outlet relative to the tank is maintained.

Optionally, the support comprises two ribs, the two ribs substantially equally spaced around (i.e. diametrically opposed across) the outlet.

Advantageously, the support meets an internal wall of the tank at a downstream end of the tank.

Conveniently, the consumable further comprises a mouthpiece comprising the mouthpiece aperture, the mouthpiece integrally formed with the tank and the outlet.

Optionally, the consumable is formed by an injection moulding process.

Advantageously, the consumable further comprises a window, so that a liquid level in the tank can be visually assessed through the window.

Conveniently, the consumable further comprises a heating device for vaporising the e-liquid to form the aerosol vapour, the heating device located in a fluid path between the tank and the mouthpiece.

According to a second aspect of the first mode of the present disclosure, there is provided a smoking device comprising a consumable as described above.

According to a third aspect of the first mode of the present disclosure, there is provided a method of manufacturing a consumable for a smoking substitute device, the method comprising integrally forming: a tank for storing an e-liquid; and an outlet, wherein the outlet is configured to provide fluid communication between the tank and a mouthpiece aperture, so that the mouthpiece aperture receives an aerosol vapour formed from the e-liquid in use, the method further comprising providing a support for maintaining a position of the outlet relative to the tank.

Optionally, the providing the support comprises integrally forming the support with the tank and the outlet.

Advantageously, the integrally forming is by an injection moulding process.

According to a fourth aspect of the first mode of the present disclosure, there is provided a manufacturing assembly comprising a first mould and a second mould, the first mould and second mould configured to be brought together to form a cavity, wherein the cavity has a shape such that when material is injected into the cavity, the material forms a consumable as described above.

The disclosure includes the combination of the aspects and preferred features described except where such a combination is clearly impermissible or expressly avoided.

Second Mode of the Disclosure: Mouthpiece

At its most general, the present disclosure relates to a consumable for a smoking substitute device comprising a mouthpiece aperture, with a mouthpiece angle between an inner surface of the mouthpiece aperture and an outer surface of the mouthpiece being less than 90 degrees.

According to a first aspect of the second mode of the present disclosure, there is provided a mouthpiece for a consumable for a smoking substitute device, the mouthpiece comprising a mouthpiece aperture, wherein the mouthpiece aperture is configured to be fluidly connected to a tank, so that the mouthpiece aperture receives an aerosol vapour formed from an e-liquid in the tank in use, wherein a mouthpiece angle between an inner surface of the mouthpiece aperture and an outer surface of the mouthpiece is less than 90 degrees.

Having a mouthpiece angle of less than 90 degrees is advantageous as it means that waste material from a process of manufacturing the consumable is less likely to remain attached to the mouthpiece aperture, reducing the likelihood of such material entering the user's mouth. This is particularly advantageous when the mouthpiece is formed in an injection moulding process, as it reduces the formation of flash in the mouthpiece aperture.

Optionally, the mouthpiece angle is less than 60 degrees.

Advantageously, an outer edge between the inner surface of the mouthpiece aperture and an outer surface of the mouthpiece is substantially rounded.

Conveniently, the outer edge is rounded at a radius of not more than 1.0 mm.

Optionally, the inner surface comprises an angled portion, wherein the angled portion extends at a substantially constant angle.

Advantageously, the mouthpiece is formed by injection moulding.

According to a second aspect of the second mode of the present disclosure, there is provided a consumable comprising a mouthpiece as described above.

Conveniently, the consumable further comprises the tank for storing the e-liquid.

Optionally, the tank and the mouthpiece are integrally formed.

Advantageously, the consumable further comprises an outlet, the outlet configured to provide fluid connection between the tank and the mouthpiece aperture.

Conveniently, the outlet is integrally formed with the tank and the mouthpiece.

According to a third aspect of the second mode of the present disclosure, there is provided a smoking substitute device comprising a mouthpiece or a consumable as described above.

According to a fourth aspect of the second mode of the present disclosure, there is provided a method of manufacturing a mouthpiece for a consumable for a smoking substitute device, the method comprising injection moulding: the mouthpiece comprising a mouthpiece aperture, wherein the mouthpiece aperture is configured to be fluidly connected to a tank, so that the mouthpiece aperture receives an aerosol vapour formed from an e-liquid in the tank in use, wherein a mouthpiece angle between an inner surface of the mouthpiece aperture and an outer surface of the mouthpiece is less than 90 degrees.

According to a fifth aspect of the second mode of the present disclosure, there is provided a manufacturing assembly comprising a first mould and a second mould, the first mould and second mould configured to brought together to form a cavity, wherein the cavity has a shape such that when material is injected into the cavity, the material forms a mouthpiece or a consumable as described above.

The disclosure includes the combination of the aspects and preferred features described except where such a combination is clearly impermissible or expressly avoided.

Third Mode of the Disclosure: Tapering Wall

At its most general, the present the third mode of the present disclosure relates to a consumable for a smoking substitute device comprising a tapering wall which forms a part of the consumable.

According to a first aspect of the third mode of the present disclosure, there is provided there is provided a consumable for a smoking substitute device, the consumable comprising: a tank for storing an e-liquid; and at least one wall forming a part of the consumable, wherein the consumable is formed by injection moulding, and the at least one wall tapers along a demoulding direction of the at least one wall.

Forming a part of the consumable from a tapering wall in this way is advantageous, as it means that the consumable may be removed more easily and reliably from a mould during an injection moulding process.

Optionally, the at least one wall comprises a tank wall.

Advantageously, the consumable comprises an outlet, the outlet configured to provide fluid communication between the tank and a mouthpiece aperture (so that the mouthpiece aperture receives an aerosol vapour formed from e-liquid in use), wherein the at least one wall comprises an outlet wall.

Conveniently, the outlet defines an airway, the outlet/airway having an internal width which decreases in a downstream direction (due to the decreasing of the thickness of the wall of the outlet along the demoulding direction).

In some embodiments, both the tank wall and the outlet wall taper (decrease in width) in the demoulding direction.

Optionally, the consumable comprises a filter for filtering unvaporised liquid from the aerosol vapour, wherein the filter is located within the outlet.

Advantageously, the thickness of the wall decreases due to a surface of the wall being angled at a draft angle. Advantageous draft angles are described below.

According to a second aspect of the third mode of the present disclosure, there is provided a consumable for a smoking substitute device, the consumable comprising: a tank for storing an e-liquid; an outlet, wherein the outlet is configured to provide fluid communication between the tank and a mouthpiece aperture, so that the mouthpiece aperture receives an aerosol vapour formed from the e-liquid in use, wherein the outlet has an internal width which decreases in a downstream direction.

Having an outlet with internal width decreasing in this way is advantageous, as it means that the air flow velocity in the upstream portion of the outlet is reduced, which reduces the amount of unvapourised e-liquid entrained in the air flow.

Optionally, the outlet comprises an outlet wall, wherein a thickness of the outlet wall tapers/decreases in an upstream direction to cause the internal width of the outlet to decrease in the downstream direction.

Advantageously, the consumable is formed by injection moulding. The thickness of the wall may decrease due to a surface of the wall being angled at a draft angle. Advantageous draft angles are defined below.

Advantageously, the internal width of the outlet decreases at a substantially constant rate in the downstream direction.

Conveniently, a difference between an internal width at the downstream end of the outlet and an internal width at the upstream end of the outlet is greater than 0.10 mm or greater than 1.5 mm.

Conveniently, the difference between the internal width at the downstream end of the outlet and the internal width at the upstream end of the outlet is not more than 0.30 mm.

In some embodiments, the outlet may be integrally formed with a tank wall. The tank wall may taper (i.e. decrease in thickness) in the opposite direction (i.e. upstream) as the reduction in internal width of the outlet i.e. it may taper in the same direction as the outlet wall tapers.

In either of the first or second aspects, advantageously, the consumable comprises a heating device for vaporising the e-liquid to form the aerosol vapour.

Conveniently, the consumable of the first or second aspect of the third mode comprises a mouthpiece, the mouthpiece comprising the mouthpiece aperture, wherein the mouthpiece aperture is in fluid communication with the tank, so that the mouthpiece aperture receives an aerosol vapour formed from the e-liquid in use.

The mouthpiece aperture may be provided in an axial end surface of the mouthpiece i.e. in an end surface extending in a plane perpendicular to the longitudinal axis of the consumable. The mouthpiece aperture may be provided in the end surface of the mouthpiece aligned with the longitudinal axis of the consumable.

Optionally, the outlet provides fluid communication between the heating device and the mouthpiece aperture.

In either of the first or second aspect of the third mode, conveniently, the draft angle is at least 0.5 degrees, e.g. at least 1.0 degrees or at least 1.5 degrees such as at least 2.0 degrees or at least 2.5 degrees, for example at least 3.0 degrees or at least 3.5 degrees.

Conveniently, the draft angle is not more than 3.5 degrees, e.g. not more than 3.0 degrees or not more than 2.5 degrees such as not more than 2.0 degrees or not more than 1.5 degrees, for example, not more than 1.0 degrees or not more than 0.5 degrees.

It should be noted that references herein to "downstream" are intended to refer to a direction towards the mouthpiece (with "upstream" referring to a direction away from the mouthpiece).

According to a third aspect of the third mode of the present disclosure, there is provided a smoking substitute device comprising a consumable as described above according to the first or second aspect of the third mode.

According to a fourth aspect of the third mode of the present invention, there is provided a method of manufacturing a consumable for a smoking substitute device, the method comprising injection moulding: a tank for storing an e-liquid; and at least one wall forming a part of the consumable, wherein the injection moulding comprises removing a first mould along a demoulding direction of the at least one wall, wherein the at least one wall tapers along the demoulding direction.

The at least one wall may be as described above for the first aspect of the third mode.

According to a fifth aspect of the third mode of the present disclosure, a manufacturing assembly comprising a first mould and a second mould, the first mould and second mould configured to brought together to form a cavity, wherein the cavity has a shape such that when material is injected into the cavity, the material forms a consumable as described above for the first or second aspect.

The disclosure includes the combination of the aspects and preferred features described except where such a combination is clearly impermissible or expressly avoided.

Fourth Mode of the Disclosure: Outlet Having a Void Downstream of a Filter

At its most general, the fourth mode of the present disclosure relates to a consumable for a smoking substitute device comprising an outlet in which a filter is located, the outlet comprising a void downstream of the filter.

According to a first aspect of the fourth mode of the present disclosure, there is provided a consumable for a smoking substitute device, the consumable comprising: a tank for storing an e-liquid; an outlet, wherein the outlet is configured to provide fluid communication between the tank and a mouthpiece aperture, so that the mouthpiece aperture receives an aerosol vapour formed from the e-liquid in use; and a filter for filtering unvaporised liquid out of the aerosol vapour, wherein the filter is located within the outlet, and the filter is shorter than the outlet, such that the outlet comprises a void.

The void provides a portion of the outlet for condensation settling, which means that unvaporised e-liquid can condense within the outlet. This reduces the amount of unvaporised e-liquid which reaches the mouthpiece and the user's mouth.

Advantageously, the outlet is elongate.

Conveniently, the outlet is a chimney or tube defining an elongate flow passage.

Optionally, the void comprises a downstream void portion downstream of the filter. The downstream void portion provides a portion of the outlet for condensation settling downstream of the filter, allowing unvaporised e-liquid which passes the filter to condense within the outlet.

Conveniently, the void comprises an upstream void portion upstream of the filter. The upstream void portion means that the effective width of the outlet is increased upstream of the filter, which decreases the flow velocity upstream of the filter (and immediately downstream of the wick assembly). This reduces the amount of unvaporised liquid which is carried by the air flow in the outlet.

Optionally, the outlet comprises a retainer for retaining the filter in position in the outlet. In an example, the retainer comprises a rib extending inwardly from an inner surface of the outlet to retain the filter in position in the outlet.

Advantageously, the retainer comprises a rib extending inwardly from an inner surface of the outlet to retain the filter in position in the outlet.

Conveniently, the void occupies at least 5% of the total length of the outlet. Optionally, the void occupies at least 10% of the total length of the outlet. Advantageously, the void occupies at least 15% of the total length of the outlet. Conveniently, the void occupies at least 20% of the total length of the outlet. Optionally, the void occupies at least 25% of the total length of the outlet.

Advantageously, the void occupies not more than 30% of the total length of the outlet.

Conveniently, the filter has an annular cross-section.

Optionally, the consumable further comprises a mouthpiece, the mouthpiece comprising the mouthpiece aperture.

Advantageously, the consumable further comprises a heater assembly for vaporising the e-liquid to form the aerosol vapour.

Conveniently, the outlet is configured to provide fluid communication between the heater assembly and the mouthpiece aperture.

Optionally, the tank and the outlet are integrally formed.

Advantageously, the mouthpiece is integrally formed with the tank and the outlet.

According to a second aspect of the fourth mode of the present disclosure, there is provided a smoking substitute device comprising a consumable as described above.

According to a third aspect of the fourth mode of the present disclosure, there is provided a kit of parts for a consumable for a smoking substitute device, the kit of parts comprising: a tank for storing an e-liquid; and an outlet, wherein the outlet is configured to provide fluid communication between the tank and a mouthpiece aperture, so that the mouthpiece aperture receives an aerosol vapour formed from the e-liquid in use; and a filter for filtering unvaporised liquid out of the aerosol vapour, wherein the filter is shorter than the outlet, such that the outlet is configured to comprise a void.

According to a fourth aspect of the fourth mode of the present disclosure, there is provided a method of manufacturing a consumable for a smoking substitute device, the method comprising forming: a tank for storing an e-liquid; and an outlet, wherein the outlet is configured to provide fluid communication between the tank and a mouthpiece aperture, so that the mouthpiece aperture receives an aerosol vapour formed from the e-liquid in use, the method further comprising inserting a filter into the outlet, wherein the filter is shorter than the outlet, such that the outlet comprises a void, wherein the filter is for filtering unvaporised liquid out of the aerosol vapour.

Optionally, the inserting the filter into the outlet comprises using a tool to push the filter into the outlet, wherein the tool is sized so that the filter is inserted into the outlet to the extent that the void comprises a downstream void portion downstream of the filter.

The disclosure includes the combination of the aspects and preferred features described except where such a combination is clearly impermissible or expressly avoided.

Fifth Mode of the Disclosure: Integrally Forming Tank and Mouthpiece

At its most general, the fifth mode of the present disclosure relates to a consumable for a smoking substitute device in which a tank and a mouthpiece are integrally formed.

According to a first aspect of the first mode of the present disclosure, there is provided a consumable for a smoking substitute device, the consumable comprising: a tank for storing an e-liquid; and a mouthpiece, the mouthpiece comprising a mouthpiece aperture, wherein the mouthpiece aperture is configured to be fluidly connected to the tank, so that the mouthpiece aperture receives an aerosol vapour formed from the e-liquid in use, wherein the tank and the mouthpiece are integrally formed.

The tank and the mouthpiece being integrally formed is advantageous, as it removes a possible fluid leakage path between the tank and the mouthpiece, reducing leakage of e-liquid. Additionally, it removes the need to assemble separate mouthpiece and tank components, simplifying the manufacture of the consumable.

Optionally, the tank and mouthpiece are formed of the same material as each other.

Advantageously, the tank and the mouthpiece are formed as a unitary component e.g. by injection moulding.

The mouthpiece may be provided at a lateral end of the consumable. It may comprise a lateral end wall defining the lateral end surface of the consumable. The mouthpiece aperture may be formed in the lateral end wall of the mouthpiece Conveniently, the consumable further comprises an outlet, the outlet providing fluid connection between the tank and the mouthpiece aperture, wherein the outlet is integrally formed with the tank and the mouthpiece.

Optionally, the consumable further comprises a filter for filtering unvaporised liquid out of the aerosol vapour, wherein the filter is located within the outlet. Including the filter in the outlet is particularly advantageous for a consumable in which the tank is integrally formed with the mouthpiece, as integrally forming the tank and mouthpiece means that there is no location between the tank and mouthpiece for a filter.

Advantageously, the outlet comprises a void. The void provides a portion of the outlet for condensation settling, which means that unvaporised e-liquid can condense within the outlet. This reduces the amount of unvaporised e-liquid which reaches the mouthpiece and the user's mouth. In an example, the void occupies at least 5% of the total length of the outlet.

Conveniently, the consumable is at least partially formed by an injection moulding process.

Optionally, the consumable further comprises a window, so that a liquid level in the tank can be visually assessed through the window.

Advantageously, the consumable further comprises a heating device for vaporising the e-liquid to form the aerosol vapour, the heating device located in a fluid path between the tank and the mouthpiece.

According to a second aspect of the fifth mode of the present disclosure, there is provided a there is provided a smoking device comprise a consumable as described above.

According to a third aspect of the fifth mode of the present disclosure, there is provided a method of manufacturing a consumable for a smoking substitute device, the method comprising integrally forming: a tank for storing an e-liquid; and a mouthpiece, the mouthpiece comprising a mouthpiece aperture, wherein the mouthpiece aperture is configured to be fluidly connected to the tank.

Optionally, the integrally forming is by an injection moulding process.

According to a fourth aspect of the fifth mode of the present disclosure, there is provided a manufacturing assembly comprising a first mould and a second mould, the first mould and second mould configured to be brought together to form a cavity, wherein the cavity has a shape such that when material is injected into the cavity, the material forms a consumable as described above.

The disclosure includes the combination of the aspects of the fifth mode of the present disclosure and preferred features described except where such a combination is clearly impermissible or expressly avoided.

DETAILED DESCRIPTION

Before the disclosure is described in further detail, it is to be understood that the disclosure is not limited to the particular embodiments described, and as such may, of course, vary. It is to be understood that the terminology used herein is for the purpose of describing particular embodiments only, and not intended to be limiting, since the scope of the present disclosure will be limited by the appended claims.

Unless defined otherwise, all technical and scientific terms used herein have the same meaning as commonly understood by one of ordinary skill in the art to which this invention belongs or as determined by the context in which such terms are used. Although any methods and materials similar or equivalent to those described herein can also be used in the practice or testing of the present invention, a limited number of exemplary methods and materials are described herein.

All publications mentioned herein are incorporated herein by reference to disclose and describe the methods and materials in connection with which the publications are cited. The publications discussed herein are provided solely for their disclosure prior to the filing date of the present patent application.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

The words "preferred" and "preferably" are used herein refer to embodiments of the invention that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

Aspects and embodiments of the present disclosure will now be discussed with reference to the accompanying figures. Further aspects and embodiments will be apparent to those skilled in the art. All documents mentioned in this text are incorporated herein by reference.

Figure 1B:
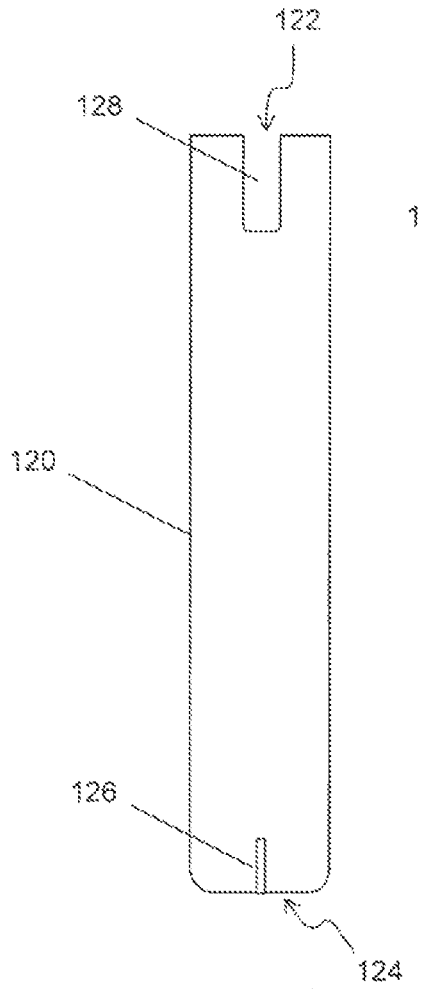
Figure 1C:
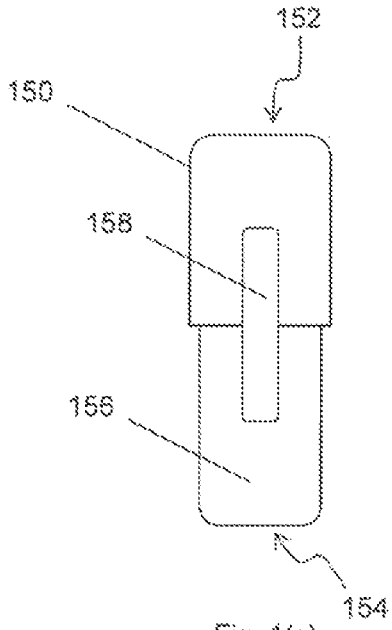

FIG. 1(*a*) shows a smoking substitute device 110. In this example, the smoking substitute device 110 includes a main body 120 and a consumable 150. The consumable 150 may alternatively be referred to as a "pod". The consumable may also be referred to as a cartridge or cartomizer.

In this example, the smoking substitute device 110 is a closed system vaping device, wherein the consumable 150 includes a sealed tank or liquid reservoir 156 and is intended for one-use only.

FIG. 1(*a*) shows the smoking substitute device 110 with the main body 120 physically coupled to the consumable 150.

FIG. 1(*b*) shows the main body 120 of the smoking substitute device 110 without the consumable 150.

FIG. 1(*c*) shows the consumable 150 of the smoking substitute device 110 without the main body 120.

The main body 120 and the consumable 150 are configured to be physically coupled together, in this example by pushing the consumable 150 into an aperture in a top end 122 of the main body 120, such that there is an interference fit between the main body 120 and the consumable 150. In other examples, the main body 120 and the consumable could be physically coupled together by screwing one onto the other, or through a bayonet fitting, for example. An optional light 126, e.g. an LED, located behind a small translucent cover, is located a bottom end 124 of the main body 120. The light 126 may be configured to illuminate when the smoking substitute device 110 is activated.

The consumable 150 includes a mouthpiece (not shown in FIG. 1(*a*)-(*c*)) at a top end 152 of the consumable 150, as well as one or more air inlets (not shown) so that air can be drawn into the smoking substitute device 110 when a user inhales through the mouthpiece. At a bottom end 154 of the consumable 150, there is located a tank 156 that contains e-liquid. The tank 156 may be a translucent body, for example.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

The tank 156 may be referred to as a "clearomizer" if it includes a window 158, or a "cartomizer" if it does not.

The consumable 150 may identify itself to the main body 120, via an electrical interface, RFID chip, or barcode.

Figure 2A:
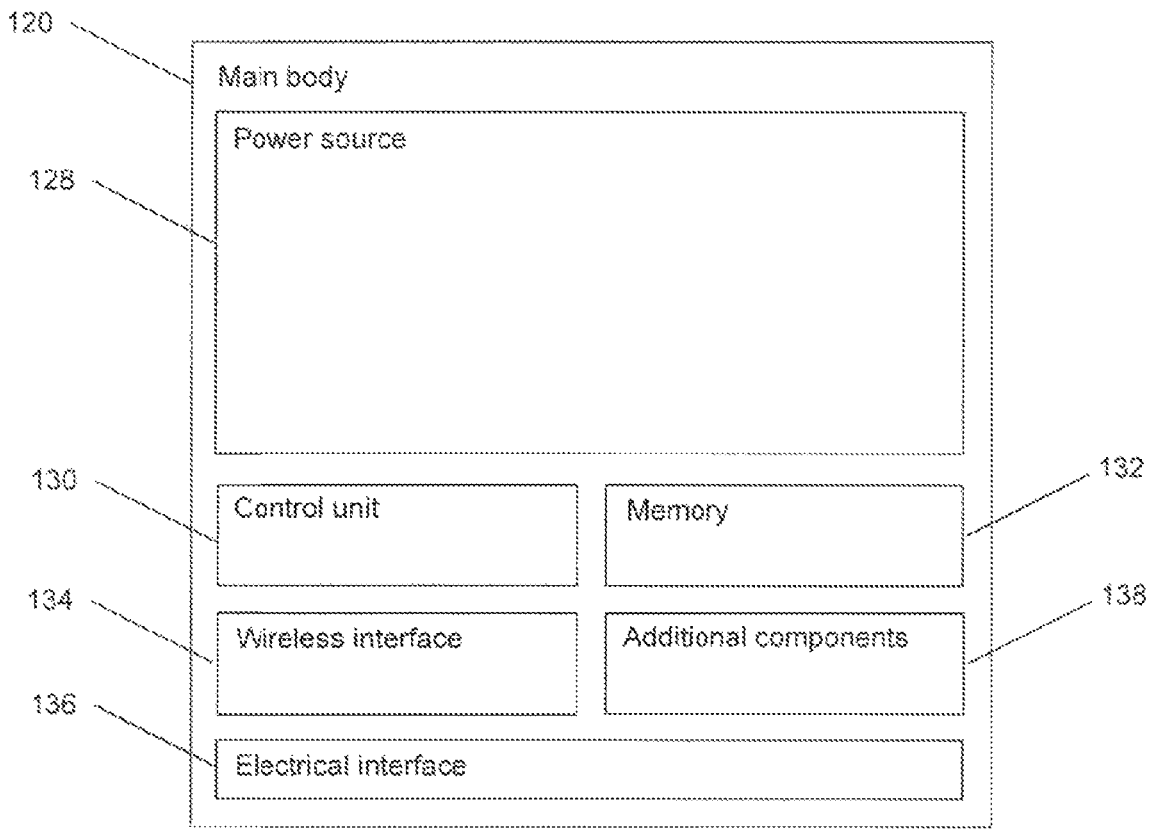
FIG. 2(*a*) is a schematic drawing of the main body.
Figure 2B:
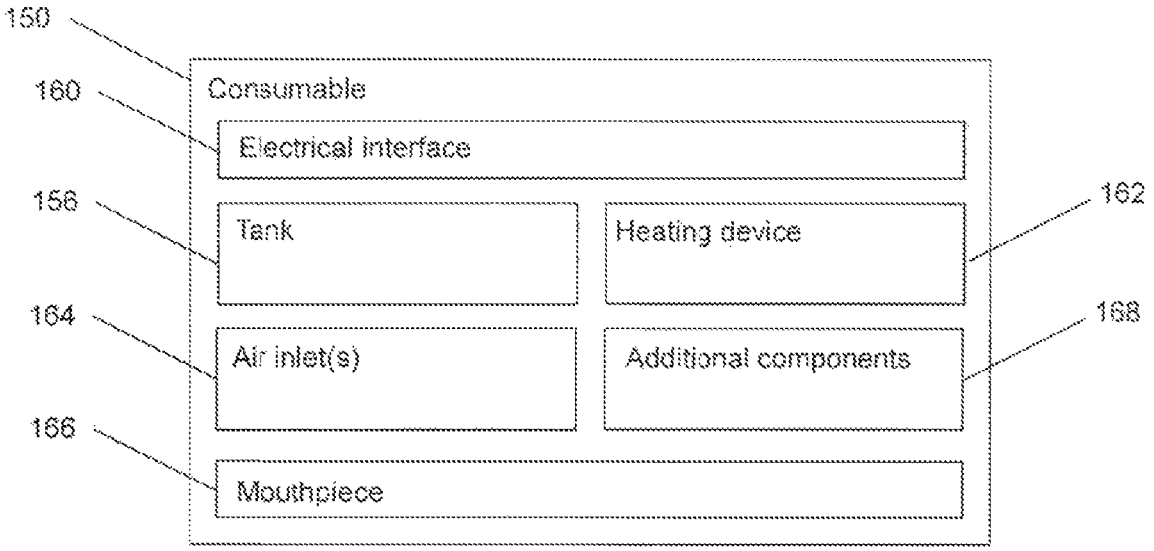

FIG. 2(*a*) is a schematic drawing of the main body 120 of the smoking substitute device 110.

FIG. 2(*b*) is a schematic drawing of the consumable 150 of the smoking substitute device 110.

As shown in FIG. 2(*a*), the main body 120 includes a power source 128, a control unit 130, a memory 132, a wireless interface 134, an electrical interface 136, and, optionally, one or more additional components 138.

The power source 128 is preferably a battery, more preferably a rechargeable battery.

The control unit 130 may include a microprocessor, for example.

The memory 132 is preferably includes non-volatile memory. The memory may include instructions which, when implemented, cause the control unit 130 to perform certain tasks or steps of a method.

The wireless interface 134 is preferably configured to communicate wirelessly with another device, for example a mobile device, e.g. via Bluetooth®. To this end, the wireless interface 134 could include a Bluetooth® antenna. Other wireless communication interfaces, e.g. WiFi®, are also possible. The wireless interface 134 may also be configured to communicate wirelessly with a remote server.

The electrical interface 136 of the main body 120 may include one or more electrical contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 128 to (e.g. a heating device of) the consumable 150 when the smoking substitute device 110 is activated, e.g. via the electrical interface 160 of the consumable 150 (discussed below). The electrical interface may be configured to receive power from a charging station, when the main body 120 is not physically coupled to the consumable 150 and is instead coupled to the charging station. The electrical interface 136 may also be used to identify the consumable 150 from a list of known consumables. For example, the consumable may be a particular flavour and/or have a certain concentration of nicotine. This can be identified to the control unit 130 of the main body 120 when the consumable is connected to the main body. Additionally, or alternatively, there may be a separate communication interface provided in the main body 120 and a corresponding communication interface in the consumable 150 such that, when connected, the consumable can identify itself to the main body 120.

The additional components 138 of the main body 120 may comprise the optional light 126 discussed above.

The additional components 138 of the main body 120 may, if the power source 128 is a rechargeable battery, comprise a charging port configured to receive power from the charging station. This may be located at the bottom end 124 of the main body 120. Alternatively, the electrical interface 136 discussed above is configured to act as a charging port configured to receive power from the charging station such that a separate charging port is not required.

The additional components 138 of the main body 120 may, if the power source 128 is a rechargeable battery, include a battery charging control circuit, for controlling the charging of the rechargeable battery. However, a battery charging control circuit could equally be located in the charging station (if present).

The additional components 138 of the main body 120 may include an airflow sensor for detecting airflow in the smoking substitute device 110, e.g. caused by a user inhaling through a mouthpiece 166 (discussed below) of the smoking substitute device 110. The smoking substitute device 110 may be configured to be activated when airflow is detected by the airflow sensor. This optional sensor could alternatively be included in the consumable 150 (though this is less preferred where the consumable 150 is intended to be disposed of after use, as in this example). The airflow sensor can be used to determine, for example, how heavily a user draws on the mouthpiece or how many times a user draws on the mouthpiece in a particular time period.

The additional components 138 of the main body 120 may include an actuator, e.g. a button. The smoking substitute device 110 may be configured to be activated when the actuator is actuated. This provides an alternative to the airflow sensor noted, as a mechanism for activating the smoking substitute device 110.

As shown in FIG. 2(*b*), the consumable 150 includes the tank 156, an electrical interface 160, a heating device 162, one or more air inlets 164, a mouthpiece 166, and, optionally, one or more additional components 168.

The electrical interface 160 of the consumable 150 may include one or more electrical contacts. The electrical interface 136 of the main body 120 and an electrical interface 160 of the consumable 150 are preferably configured to contact each other and thereby electrically couple the main body 120 to the consumable 150 when the bottom end 154 of the consumable 150 is inserted into the top end of the main body 122 (as shown in FIG. 1*a*) to physically coupled the consumable 150 to the main body 120. In this way, electrical energy (e.g. in the form of an electrical current) is able to be supplied from the power source 128 in the main body 120 to the heating device 162 in the consumable 150.

The heating device 162 is preferably configured to heat e-liquid contained in the tank 156, e.g. using electrical energy supplied from the power source 128, in order to vaporise the e-liquid. In one example, the heating device 162 includes a heating filament and a wick, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapour.

The one or more air inlets 164 are preferably configured to allow air to be drawn into the smoking substitute device 110, when a user inhales through the mouthpiece 166. When the consumable 150 is physically coupled to the main body 120, the air inlet 164 receives air which flows from the top end 122 of the main body 120, between the main body 120 and the bottom end 154 of the consumable 150.

In use, a user activates the smoking substitute device 110, e.g. through actuating an actuator included in the main body 120 or by inhaling through the mouthpiece 166 as described above. Upon activation, the control unit 130 may supply electrical energy from the power source 128 to the heating device 162 (via electrical interfaces 136, 166), which may cause the heating device 162 to heat e-liquid drawn from the tank 156 to produce a vapour which is inhaled by a user through the mouthpiece 166.

As an example of one of the one or more additional components 168, an interface for obtaining an identifier of the consumable may be provided. As discussed above, this interface may be, for example, an RFID reader, a barcode or QR code reader, or an electronic interface which is able to identify the consumable to the main body. The consumable may, therefore include any one or more of an RFID chip, a barcode or QR code, or memory within which is an identifier and which can be interrogated via the electronic interface in the main body.

Of course, a skilled reader would readily appreciate that the smoking substitute device 110 shown in FIGS. 1 and 2 shows just one example implementation of a smoking substitute device, and that other forms of smoking substitute device could be used.

As another example, an entirely disposable (one use) smoking substitute device could be used as the smoking substitute device.

Figure 3:
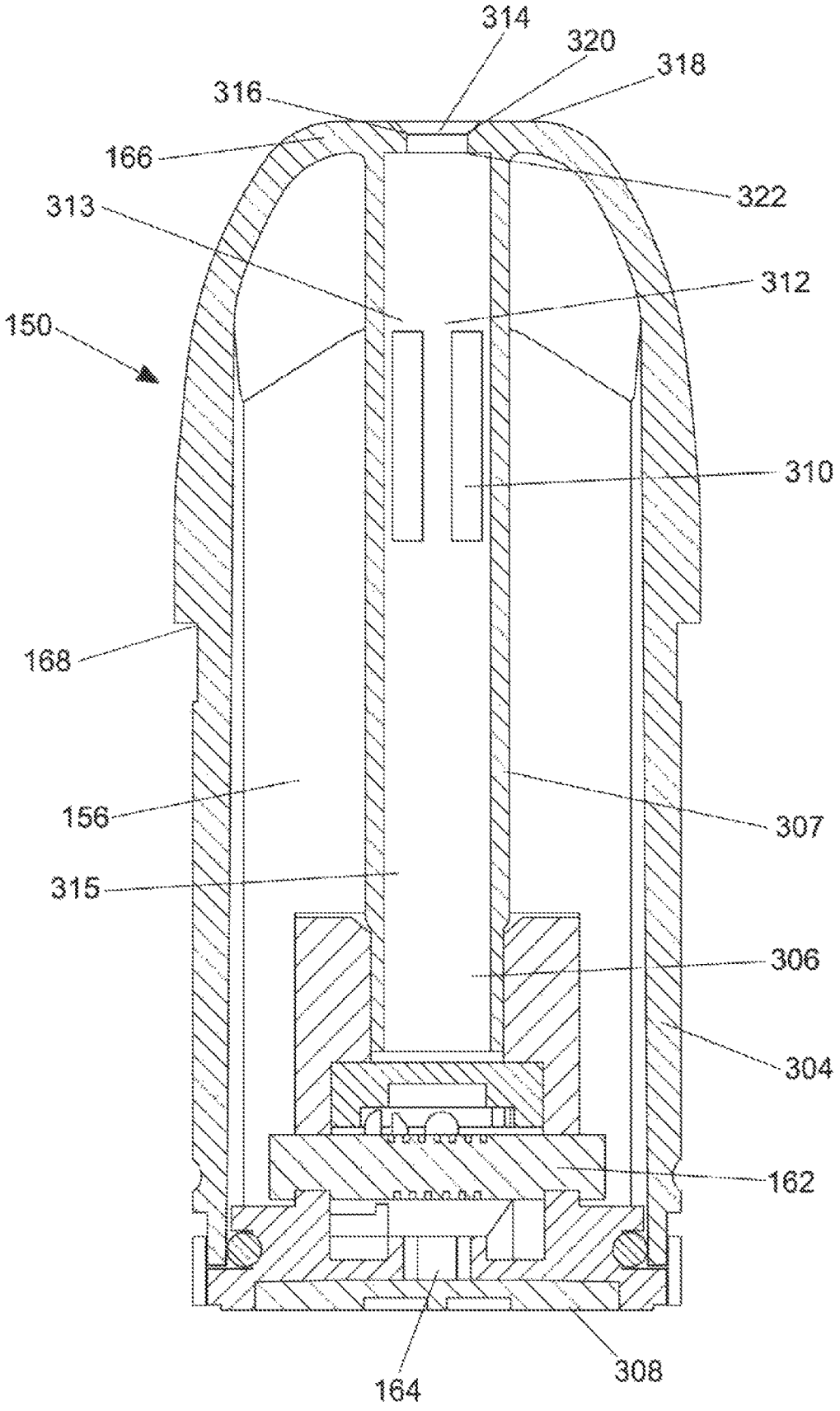
FIG. 3 is a cross-sectional view of the consumable.

FIG. 3 shows a cross-sectional view of a consumable 150. The consumable comprises a tank 156 for storing e-liquid, a mouthpiece 166 and an outlet 306, which in this example is a chimney or tube. The tank 156 surrounds the outlet 306, with the outlet extending through a central portion of the tank 156. The outlet 306 has a substantially circular cross-section.

The tank 156 is provided by an outer casing of the consumable 150. The outer casing of the consumable 150 comprises a tank wall 304. The tank wall 304 extends completely around the outlet 306 to define the tank 156 in the form of an annulus between the outlet 306 and the tank wall 304. The tank wall 304 extends from the bottom of the consumable up to the mouthpiece 166. Where the tank wall 304 meets the mouthpiece 166, the mouthpiece 166 has a larger outer width than the tank 156, which means that there is a lip 168 around the bottom of the mouthpiece 166.

The tank wall 304 tapers, which means that it has a thickness which decreases. The thickness of the tank wall 304 decreases along a first demoulding direction, as defined below with respect to FIG. 4. The first demoulding direction is a downward direction in FIG. 3, which is a direction away from the mouthpiece 166. This means that, aside from a small number of indents (for example, to provide physical connection between the consumable 150 and the main body 120), the thickness of the tank wall 304 generally decreases with increasing distance along the first demoulding direction.

The thickness of the tank wall 304 decreases due to internal surfaces of the tank wall 304 being angled to the first demoulding direction at a first tank draft angle. Additionally, the thickness of the tank wall 304 decreases due to external surfaces of the tank wall 304 being angled to the first demoulding direction at a second tank draft angle.

The first tank draft angle is preferably at least 0.5 degrees, preferably at least 1.0 degrees, preferably at least 1.5 degrees, preferably at least 2.0 degrees, preferably at least 2.5 degrees, preferably at least 3.0 degrees, preferably at least 3.5 degrees.

The second tank draft angle is preferably at least 0.5 degrees, preferably at least 1.0 degrees, preferably at least 1.5 degrees, preferably at least 2.0 degrees, preferably at least 2.5 degrees, preferably at least 3.0 degrees, preferably at least 3.5 degrees.

The first tank draft angle is preferably not more than 3.5 degrees, preferably not more than 3.0 degrees, preferably not more than 2.5 degrees, preferably not more than 2.0 degrees, preferably not more than 1.5 degrees, preferably not more than 1.0 degrees, preferably not more than 0.5 degrees.

The second tank draft angle is preferably not more than 3.5 degrees, preferably not more than 3.0 degrees, preferably not more than 2.5 degrees, preferably not more than 2.0 degrees, preferably not more than 1.5 degrees, preferably not more than 1.0 degrees, preferably not more than 0.5 degrees.

It will be appreciated that the first tank draft angle and the second tank draft angle need not be the same as each other, and may be selected independently according to the above draft angles. In fact, one of the first tank draft angle and the second tank draft angle may be substantially 0 degrees, while the other may vary as described above.

Similarly, the outlet 306 comprises an outlet wall 307. The outlet wall 307 extends fully around the circular cross-section of the outlet 306 to provide the outlet 306. The outlet wall 307 tapers, which means that it has a thickness which decreases. The thickness of the outlet wall 307 decreases along the first demoulding direction, as defined below with respect to FIG. 4. As before, the first demoulding direction is a downward direction in FIG. 3, which is a direction away from the mouthpiece 166. This means that the thickness of the outlet wall 307 generally decreases along the first demoulding direction. The thickness of the outlet wall 307 decreases due to an inner surface of the outlet wall 307 being angled to the first demoulding direction at a first outlet draft angle. Additionally, the thickness of the outlet wall 307 decreases due to an external surface of the outlet wall 307 being angled to the first demoulding direction at a second outlet draft angle.

The first outlet draft angle is preferably at least 0.5 degrees, preferably at least 1.0 degrees, preferably at least 1.5 degrees, preferably at least 2.0 degrees, preferably at least 2.5 degrees, preferably at least 3.0 degrees, preferably at least 3.5 degrees.

The second outlet draft angle is preferably at least 0.5 degrees, preferably at least 1.0 degrees, preferably at least 1.5 degrees, preferably at least 2.0 degrees, preferably at least 2.5 degrees, preferably at least 3.0, preferably at least 3.5.

The first outlet draft angle is preferably not more than 3.5 degrees, preferably not more than 3.0 degrees, preferably not more than 2.5 degrees, preferably not more than 2.0 degrees, preferably not more than 1.5 degrees, preferably not more than 1.0 degrees, preferably not more than 0.5 degrees.

The second outlet draft angle is preferably not more than 3.5 degrees, preferably not more than 3.0 degrees, preferably not more than 2.5 degrees, preferably not more than 2.0 degrees, preferably not more than 1.5 degrees, preferably not more than 1.0 degrees, preferably not more than 0.5 degrees.

It will be appreciated that the first outlet draft angle and the second outlet draft angle need not be the same as each other, and may be selected independently according to the above draft angles. In fact, one of the first outlet draft angle and the second outlet draft angle may be substantially 0 degrees, while the other may vary as described above.

Similarly, the outlet draft angles and tank draft angles may be selected independently from each other according to the above draft angles.

The outlet 306 has an internal width (i.e. a width/diameter of a passage through the outlet 306) which generally decreases in a downstream direction (i.e. downstream with respect to the fluid flow when a user inhales, which is an upward direction in FIG. 3). The downstream direction is a direction towards the mouthpiece 166 and, in this example, is an opposite direction to the first demoulding direction. This decrease in width occurs due to the second outlet draft angle described above.

The airway has an internal width of more than 2.5 mm at an upstream end of the outlet 306. More specifically, the airway has an internal width of more than 2.7 mm at an upstream end of the outlet 306. Yet more specifically, the airway has an internal width of more than 2.9 mm at an upstream end of the outlet 306. Yet more specifically, the airway has an internal width of more than 3.1 mm at an upstream end of the outlet 306. Yet more specifically, the airway has an internal width of more than 3.3 mm at an upstream end of the outlet 306.

The airway has an internal width not more than 4.5 mm at a downstream end of the outlet 306. More specifically, the airway has an internal width not more than 4.3 mm at a downstream end of the outlet 306. More specifically, the airway has an internal width not more than 4.1 mm at a downstream end of the outlet 306. More specifically, the airway has an internal width not more than 3.9 mm at a downstream end of the outlet 306. More specifically, the airway has an internal width not more than 3.7 mm at a downstream end of the outlet 306.

A difference between the internal width at the downstream end of the outlet 306 and the internal width at the upstream end of the outlet 306 is more than 0.10 mm. More specifically, the difference between the internal width at the downstream end of the outlet 306 and the internal width at the upstream end of the outlet 306 is more than 0.12 mm. More specifically, the difference between the internal width at the downstream end of the outlet 306 and the internal width at the upstream end of the outlet 306 is more than 0.14 mm. More specifically, the difference between the internal width at the downstream end of the outlet 306 and the internal width at the upstream end of the outlet 306 is more than 0.16 mm. More specifically, the difference between the internal width at the downstream end of the outlet 306 and the internal width at the upstream end of the outlet 306 is more than 0.18 mm.

The difference between the internal width at the downstream end of the outlet 306 and the internal width at the upstream end of the outlet 306 is not more than 0.30 mm. More specifically, the difference between the internal width at the downstream end of the outlet 306 and the internal width at the upstream end of the outlet 306 is not more than 0.28 mm. More specifically, the difference between the internal width at the downstream end of the outlet 306 and the internal width at the upstream end of the outlet 306 is not more than 0.26 mm. More specifically, the difference between the internal width at the downstream end of the outlet 306 and the internal width at the upstream end of the outlet 306 is not more than 0.24 mm. More specifically, the difference between the internal width at the downstream end of the outlet 306 and the internal width at the upstream end of the outlet 306 is not more than 0.22 mm.

More specifically, the difference between the internal width at the downstream end of the outlet 306 and the internal width at the upstream end of the outlet 306 is substantially 0.20 mm. The outlet 306 is substantially 30 mm long. In other examples, the outlet 306 may have a length less than 30 mm.

The airway has an internal width less than 5.0 mm at an upstream end of the outlet 306. More specifically, the airway has an internal width less than 4.5 mm at the upstream end of the outlet 306. More specifically, the airway has an internal width less than 4.2 mm at the upstream end of the outlet 306. More specifically, the airway has an internal width less than 4.0 mm at the upstream end of the outlet 306. More specifically, the airway has an internal width less than 3.8 mm at the upstream end of the outlet 306.

The airway has an internal width greater than 2.0 mm at the upstream end of the outlet 306. More specifically, the airway has an internal width greater than 2.5 mm at the upstream end of the outlet 306. More specifically, the airway has an internal width greater than 3.0 mm at the upstream end of the outlet 306. More specifically, the airway has an internal width greater than 3.2 mm at the upstream end of the outlet 306. More specifically, the airway has an internal width greater than 3.4 mm at the upstream end of the outlet 306.

More specifically, the airway has an internal width of substantially 3.6 mm at the upstream end of the outlet 306.

The airway has an internal width less than 4.8 mm at a downstream end of the outlet 306. More specifically, the airway has an internal width less than 4.3 mm at the downstream end of the outlet 306. More specifically, the airway has an internal width less than 4.0 mm at the downstream end of the outlet 306. More specifically, the airway has an internal width less than 3.8 mm at the downstream end of the outlet 306. More specifically, the airway has an internal width less than 3.6 mm at the downstream end of the outlet 306.

The airway has an internal width greater than 1.8 mm at the downstream end of the outlet 306. More specifically, the airway has an internal width greater than 2.3 mm at the upstream end of the outlet 306. More specifically, the airway has an internal width greater than 2.8 mm at the downstream end of the outlet 306. More specifically, the airway has an internal width greater than 3.0 mm at the downstream end of the outlet 306. More specifically, the airway has an internal width greater than 3.2 mm at the downstream end of the outlet 306.

More specifically, the airway has an internal width of substantially 3.4 mm at a downstream end of the outlet 306. The mouthpiece 166 comprises a mouthpiece aperture 314. The outlet 306 fluidly connects the heating device 162 to the mouthpiece 166, and, more specifically, the outlet 306 fluidly connects the heating device 162 to the mouthpiece aperture 314.

The mouthpiece aperture 314 has a radially inwardly directed inner surface 316. The inner surface 316 of the mouthpiece aperture 314 joins an outer surface 318 of the mouthpiece 166 (i.e. a surface which the user inserts into their mouth in use) at an outer edge 320 of the mouthpiece aperture 314. The outer edge 320 surrounds the mouthpiece aperture 314.

At the outer edge 320, the angle between the inner surface 316 of the mouthpiece aperture 314 and the outer surface 318 of the mouthpiece 166 (i.e. the "mouthpiece angle") is less than 90 degrees. In the present example, this is due to the outer edge 320 being rounded to define a substantially smooth curve. For the purposes of this disclosure, the rounded portion is considered to be part of the inner surface 316. In this case, where the outer edge 320 is rounded, the mouthpiece angle is substantially 0 degrees. The smooth curve extends between the outer surface 318 and a lower portion of the inner surface 316, the lower portion extending in a substantially downward direction in FIG. 3 (i.e. normal to the outer surface 318 at the outer edge 320 and parallel to the direction of fluid flow in the outlet 306).

In the present example, the curve followed by the rounded portion is substantially an arc of a circle. The radius of the rounded portion is preferably less than 1.0 mm. More specifically, the radius of the rounded portion is less than 0.8. More specifically, the radius of the rounded portion is less than 0.6 mm.

The radius of the rounded portion is greater than 0.2 mm. More specifically, the radius of the rounded portion is greater than 0.4 mm.

However, in other examples, the radius of the rounded portion is less than 0.4 mm, and may be less than 0.2 mm. However, the rounded portion need not follow such a curve, and could be any substantially smooth curve.

In other examples, the outer edge 320 is not rounded, and is instead chamfered or bevelled, such that the inner surface 316 comprises an angled portion, which extends at constant angle from the outer edge 320. Such a portion may extend the full depth of the mouthpiece aperture 314 (i.e. up to an inner edge 322, where the mouthpiece aperture 314 meets an inner surface of the mouthpiece 166), or may extend only part of the depth of the mouthpiece aperture 314, up to a lower portion extending in the substantially downward direction as described above.

The mouthpiece angle is preferably less than 75 degrees, preferably less than 60 degrees, preferably less than 45 degrees, preferably less than 30 degrees, preferably less than 15 degrees, preferably substantially 0 degrees.

In other examples, the inner surface 316 may comprise a combination of rounded portions and angled portions, and may include several angled portions angled at different angles.

Within the tank 156 there is a heating device 162, which in this example is a coil and wick assembly. The heating device 162 comprises an outer shell with one or more apertures. These apertures are filled with a wick material, so that e-liquid may only ingress the heating device 162 from the tank 156 via capillary action. The wick material passes through or proximal to a coil, which is connected to one or more electrical contacts.

The consumable 150 further comprises a tank seal 308, which seals a bottom portion of the tank 156 beneath the heating device 162. The tank seal 308 is connected to the heating device 162, and the tank seal 308 comprises an air inlet 164, such that air flow is permitted from outside the tank through the air inlet 164 to the heating device 162.

The tank 156, the outlet 306 and the mouthpiece 166 are integrally formed with each other. The tank 156, the outlet 306 and the mouthpiece 166 make up a single component formed from a continuous piece of material. The tank 156, the outlet 306 and the mouthpiece 166 are formed in an injection moulding process as described below with respect to FIG. 4. The tank 156, the outlet 306 and the mouthpiece 166 are made of a thermoplastic material. More specifically, the tank 156, the outlet 306 and the mouthpiece 166 are made of polypropylene.

The outlet 306 comprises a filter 310 located within the outlet 306. The filter 310 is tubular with an annular cross-section, and an outer surface of the filter 310 is in contact with an inner surface of the outlet 306. The outlet 306 comprises a void 312, and the filter 310 does not extend into the void 312. The void 312 is a portion of the outlet 306 in which no filter is present.

The void 312 comprises a downstream void portion 313 downstream of the filter 310. The downstream portion is located above the filter 310 and below the mouthpiece aperture 314 in FIG. 3. In other examples, the filter 310 extends to the mouthpiece aperture 314. The void 312 further comprises an upstream void portion 315 upstream of the filter 310. The void 312 occupies preferably at least 5% of a total length of the outlet 306, preferably at least 10% of the total length of the outlet 306, preferably at least 15% of the total length of the outlet 306, preferably at least 20% of the total length of the outlet 306, preferably at least 25% of the total length of the outlet 306.

The void 312 occupies preferably not more than 30% of a total length of the outlet 306, preferably not more than 25% of the total length of the outlet 306, preferably not more than 20% of the total length of the outlet 306, preferably not more than 15% of the total length of the outlet 306, preferably not more than 10% of the total length of the outlet 306. In this example, the filter 310 has a length of substantially 25 mm.

The outlet 306 comprises a retainer (not shown) which retains the filter 310 in position in the outlet 306. The retainer comprises a rib, which extends inwardly from an inner surface of the outlet to retain the filter in position in the outlet by an interference fit.

The filter 310 is made from a fabric, which may be cotton or another fibre. The filter may be formed of a mesh. The filter permits flow of vaporised e-liquid through the filter 310, but prevents flow of unvaporised e-liquid through the filter 310. This reduces leakage of unvaporised e-liquid into the user's mouth. The filter 310 may be a gas-permeable and liquid-impermeable membrane.

In use, when the consumable 150 is connected to the main body 120, the user inserts the mouthpiece 166 into their mouth. The user inhales through the mouthpiece aperture 314, which draws air through the air inlet 164 and into the heating device 162.

At the same time, an electrical current is provided to the one or more contacts, which causes heating of the coil, and consequent vaporisation of the e-liquid within the wick material. The air flow passes through the coil and wick assembly, drawing with it vaporised e-liquid to form the aerosol vapour. The aerosol vapour flows up the outlet 306, before exiting the consumable 150 via mouthpiece aperture 314. The e-liquid only enters the coil and wick assembly via the one or more apertures and then, only via the wick.

As the aerosol vapour flows through the outlet 306, it passes the filter 310, which filters unvaporised e-liquid out of the aerosol vapour. The void 312 provides a portion of the outlet 306 for condensation settling. The void 312 provides an unobstructed portion of the inner surface of the outlet 306 at which unvaporised e-liquid which remains in the aerosol vapour downstream of the filter 314 can condense and flow down the inner surface of the outlet 306 into the filter 314. This further reduces leakage of unvaporised e-liquid into the user's mouth.

Figure 4:
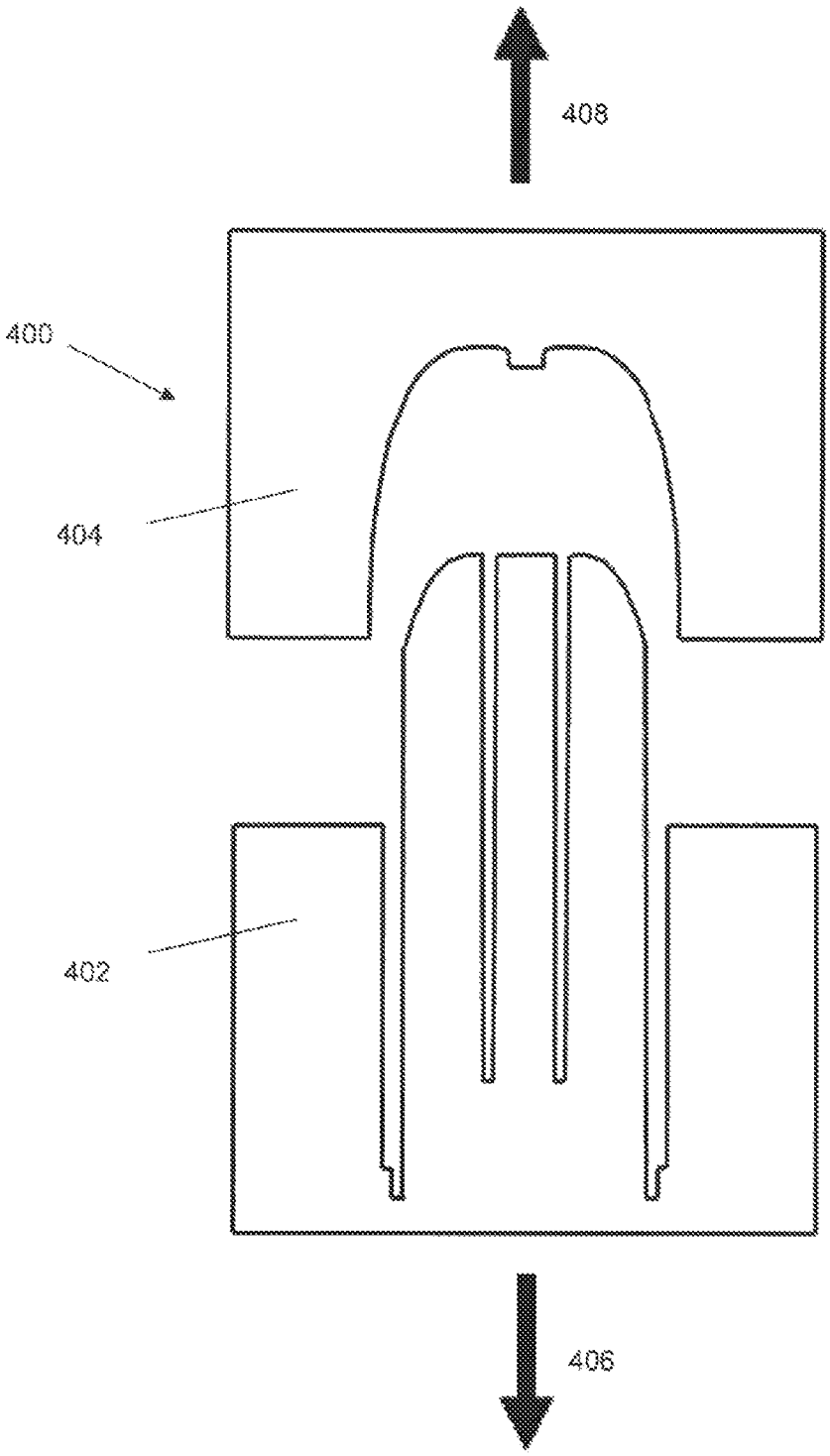
FIG. 4 is a cross-sectional view of a manufacturing assembly.

FIG. 4 shows a drawing of a manufacturing assembly 400 which is used to manufacture the consumable 150. The manufacturing assembly 400 comprises a first mould 402 and a second mould 404.

The first mould 402 has a shape which complements that of a first end (a lower end in FIG. 3) of the integrally formed tank 156, mouthpiece 166 and outlet 306. The first mould 402 therefore has a shape which matches the inner surfaces of the tank 156, and the inner and outer surfaces of the outlet 306.

The second mould 404 has a shape which complements that of a second end (an upper end in FIG. 4) of the integrally formed tank 156, mouthpiece 166 and outlet 306. The second mould 404 therefore has a shape which matches the outer surface 318 of the mouthpiece 166 and the inner surface 316 of the mouthpiece aperture 314.

When the first mould 402 and the second mould 404 are brought together, they define a closed cavity which has the shape of the tank 156, the mouthpiece 166 and the outlet 306.

To manufacture the tank 156, the mouthpiece 166 and the outlet 306, heated material is injected into the cavity between the first mould 402 and the second mould 404. At this point, the first mould 402 and the second mould 404 meet at a boundary between external surfaces of the mouthpiece 166 and the tank 156.

The material is subsequently cooled, and the first mould 402 and the second mould 404 are separated, with the first mould 402 travelling in the first demoulding direction 406 (i.e. away from the second mould 404) and the second mould 404 travelling in a second demoulding direction 408 (i.e. away from the first mould 402 and opposite to the first demoulding direction 406). For a particular component, a demoulding direction is a direction along which a mould which contacts that component is removed during an injection moulding process.

The filter 310 is then inserted into the outlet 306, and the heating device 162, tank seal 308 and any additional components are inserted into the tank 156. The filter 310 is pushed into the outlet 306 through the upstream end of the outlet 306. Since the filter 310 is shorter than the outlet 306, the outlet 306 comprises the void 312.

In some examples (particularly where the void comprises the downstream void portion 313), the filter 310 is pushed into the outlet 306 using an insertion tool (not shown), with the insertion tool sized so that the filter 310 is inserted such that the filter 310 does not extend to the downstream end of the outlet 306, thereby providing the downstream void portion 313. In other examples, the filter 310 is pushed fully up to the mouthpiece aperture 314, with the filter 310 abutting against the mouthpiece aperture 314, which is narrower than the outlet 306.

Figure 5A:
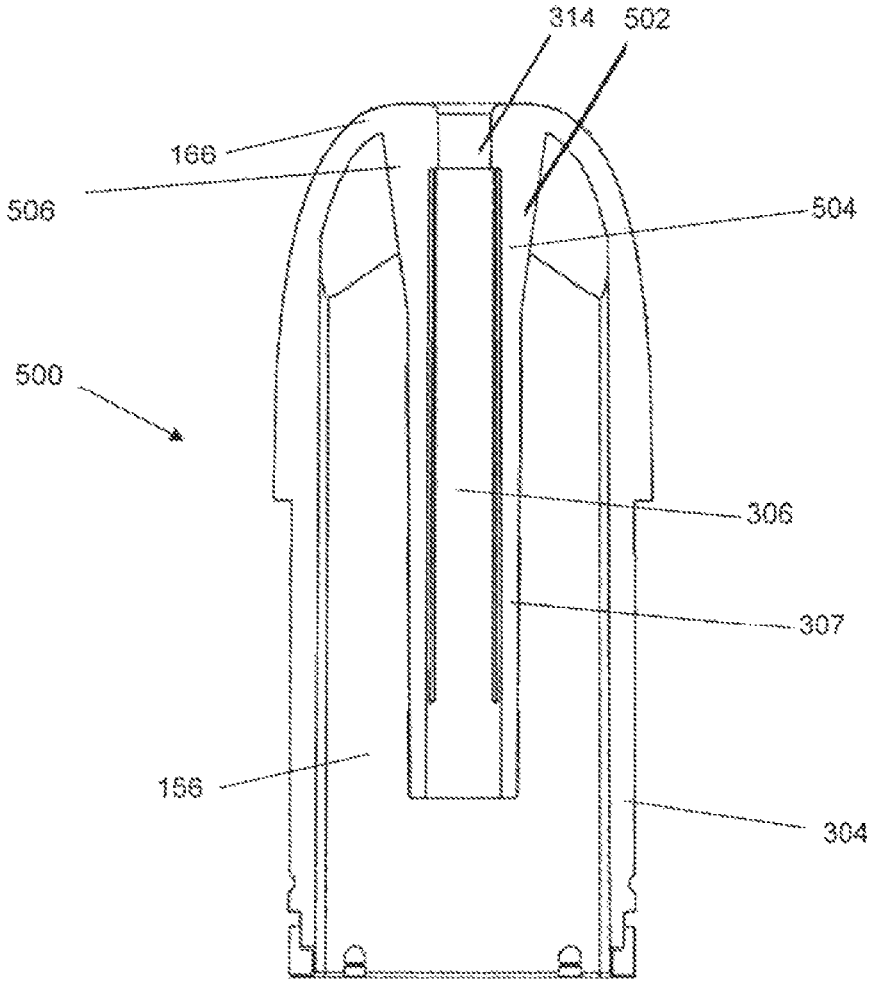
FIG. 5(*a*) is a cross-sectional view of a portion of a second consumable.
Figure 5B:
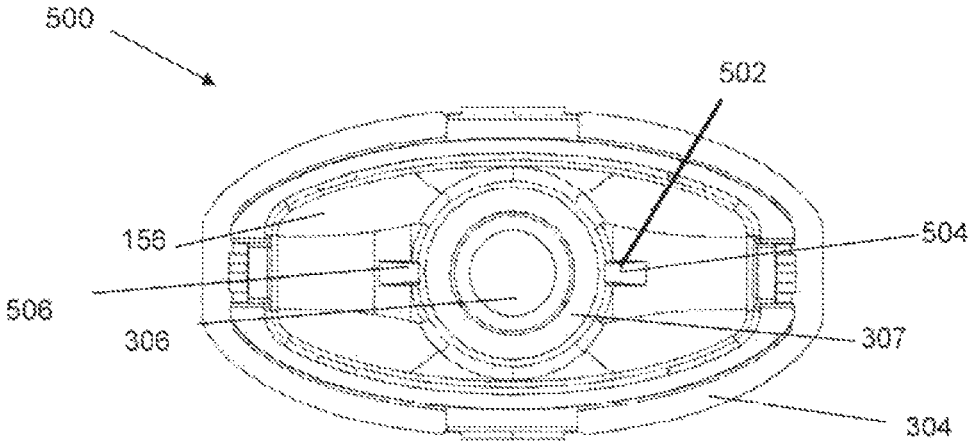

Referring to FIGS. 5*a* and 5*b*, there is shown a portion of a second consumable 400. For clarity, the heating device 162, the tank seal 308 and the filter 310 are omitted from FIG. 5*a* and FIG. 5*b*. However, the portion of the second consumable 250 is for use with the heating device 162, tank seal 308, filter 310 and any additional components described above.

The second consumable 500 comprises all of the features of the consumable 150 as described above. Many of the reference numerals relating to those features are omitted from FIG. 5*a* and FIG. 5*b* for clarity. However, like reference numerals are used in FIGS. 5*a* and 5*b* where features referred to previously are referred to again.

In addition to the features which are common with the consumable 150, the second consumable 500 comprises a support 502. The support 502 comprises a first rib 504 and a second rib 506.

Each of the first and second ribs 504, 506 extends in a radially outward direction (with respect to the central axis of the outlet) from an external surface of the outlet wall 307 to an inner surface of the tank wall 304. More specifically, each of the first and second ribs 504, 506 extends to the inner surface of the tank wall 304 at a downstream end of the second consumable 500, where the tank wall 304 is also a wall of the mouthpiece 166.

Each of the first and second ribs 504, 506 also extends from an external surface of a wall of the mouthpiece aperture 314. Since the external surface of the wall of the mouthpiece aperture 314 is continuous with the external surface of the outlet wall 307, each of the first and second ribs 504, 506 connects to the external surfaces of the wall of the mouthpiece aperture and the outlet up to the downstream end of the second consumable 500.

As best illustrated in FIG. 5*b*, the first and second ribs 504, 506 are substantially equally spaced around the outlet 306. More specifically, the first and second ribs 504, 506 are spaced from each other by 180 degrees around the central axis of the outlet 306. The first and second ribs 504, 506 are substantially aligned with a horizontal (as shown in FIG. 5*b*) line of symmetry of the outlet, and extend along a line equidistant between front and rear portions of the second consumable 500.

The support 502 is formed of the same material as the outlet 306 and the tank 156. The support 502 is integrally formed with the tank 156 and the outlet 306.

The second consumable 500 operates in the same way as the consumable 150, with the support 502 providing structural support to maintain the outlet 306 in alignment with the heating device in use.

The second consumable 500 is manufactured through the same process as that described in FIG. 4, with the manufacturing assembly 400 modified so that the closed cavity formed when the first and second moulds 402, 404 are brought together further defines the shape of the support 502. The support 502 provides structural support to the outlet 306 during demoulding and subsequent assembly of the second consumable 500.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include," and variations such as "comprises," "comprising," and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The invention claimed is:

1. A consumable for a smoking substitute device, the consumable comprising:

a tank for storing an e-liquid;

an outlet, wherein the outlet is configured to provide fluid communication between the tank and a mouthpiece aperture, so that the mouthpiece aperture receives an aerosol vapour formed from the e-liquid in use, wherein the outlet is integrally formed with the tank; and a support for maintaining a position of the outlet relative to the tank, wherein the support comprises a rib.

2. The consumable according to claim 1, wherein the support is integrally formed with the tank and outlet.

3. The consumable according to claim 1, wherein the rib extends in a radially outward direction from the outlet to an internal surface of a wall of the tank.

4. The consumable according to claim 3, wherein the support comprises two ribs, the two ribs substantially equally spaced around the outlet.

5. The consumable according to claim 4, wherein the support meets an internal wall of the tank at a downstream end of the tank.

6. The consumable according claim 1 and further comprising a mouthpiece comprising the mouthpiece aperture, the mouthpiece integrally formed with the tank and the outlet.

7. The consumable according to claim 1, wherein the consumable is formed by an injection moulding process.

8. The consumable according to claim 1 and further comprising a window, so that a liquid level in the tank can be visually assessed through the window.

9. The consumable according to claim 1 and further comprising a heating device for vaporising the e-liquid to form the aerosol vapour, the heating device located in a fluid path between the tank and the mouthpiece.

10. A smoking substitute device comprising the consumable according to claim 1.

11. A manufacturing assembly comprising a first mould and a second mould, the first mould and second mould configured to be brought together to form a cavity, wherein the cavity has a shape such that when material is injected into the cavity, the material forms the consumable according to claim 1.

12. A method of manufacturing a consumable for a smoking substitute device, the method comprising integrally forming:

a tank for storing an e-liquid; and an outlet, wherein the outlet is configured to provide fluid communication between the tank and a mouthpiece aperture, so that the mouthpiece aperture receives an aerosol vapour formed from the e-liquid in use, the method further comprising providing a support for maintaining a position of the outlet relative to the tank, wherein the support comprises a rib.

13. The method according to claim 12, wherein the providing the support comprises integrally forming the support with the tank and the outlet.

14. The method according to claim 13, wherein the integrally forming is by an injection moulding process.

* * * * *